US005462277A

United States Patent [19]

Takemoto

[11] Patent Number: 5,462,277

[45] Date of Patent: Oct. 31, 1995

[54] GAME MACHINE HAVING AN APPARATUS FOR SHOWING PRIZE AWARDING COMBINATIONS ON ROTATING DRUMS

[75] Inventor: Takatoshi Takemoto, Tokyo, Japan

[73] Assignee: Kabushiki Kaisha Ace Denken, Japan

[21] Appl. No.: 274,493

[22] Filed: Jul. 13, 1994

[30] Foreign Application Priority Data

Jul. 15, 1993 [JP] Japan ..... 5-175021

[51] Int. Cl.[6] ..... A63F 7/02; A63F 9/24

[52] U.S. Cl. ..... 273/121 B; 273/138 A; 273/143 R

[58] Field of Search ..... 273/141 R, 145 R, 273/138 A, 121 A, 121 B, 138 R

[56] References Cited

U.S. PATENT DOCUMENTS

| | | | |
|---|---|---|---|
| 3,136,550 | 6/1964 | Ruderian | 273/143 R |
| 4,570,934 | 2/1986 | Smyth | 273/143 R |
| 4,618,150 | 10/1986 | Kimura | 273/143 R |
| 4,790,537 | 12/1988 | Smyth et al. | 273/143 R |
| 5,342,049 | 8/1994 | Wichinsky et al. | 273/119 R |
| 5,344,145 | 9/1994 | Chadwick et al. | 273/138 A |
| 5,362,052 | 11/1994 | Kobatsch | 273/145 R |

FOREIGN PATENT DOCUMENTS

| | | | |
|---|---|---|---|
| 1-317469 | 12/1989 | Japan . | |
| 2156565 | 10/1985 | United Kingdom | 273/143 R |

*Primary Examiner*—Jessica J. Harrison

*Attorney, Agent, or Firm*—Andrus, Sceales, Starke & Sawall

[57] ABSTRACT

An apparatus for showing prize awarding combinations for a game machine having three rotating drums. The apparatus for showing prize awarding combinations comprises; a first rotating drum having an outer peripheral surface on which a plurality of symbols are shown, which is rotatable around an axis; a second rotating drum having an outer peripheral surface on which the plurality of symbols are shown, which is arranged adjacent to one side of the first rotating drum and rotatably around the axis; a third rotating drum having an outer peripheral surface on which the plurality of symbols are shown, which is arranged adjacent to another side of the first rotating drum and rotatable on the axis; and a rotation control means for controlling rotation of each of the first, second, and third drums, respectively. The first, second and third drums form a spherical shape in combination.

11 Claims, 3 Drawing Sheets

GAME MACHINE HAVING AN APPARATUS FOR SHOWING PRIZE AWARDING COMBINATIONS ON ROTATING DRUMS

BACKGROUND OF THE INVENTION

1. Field of the Invention

The present invention relates to a game machine such as a pachinko machine or a slot machine. In particular, the present invention relates to a game machine having three rotating drums for indicating prize awarding combinations on a game board.

In such a conventional game machine, diameters of the three rotating drums provided on the game board are the same, and the rotating drums are arranged in a row sharing an axis, thereby forming a cylindrical shape in combination. A combination of symbols (marks) such as characters or patterns is indicated on an outer peripheral surface of each drum, and the characters and the patterns are all of the same size.

The three rotating drums of the pachinko machine start rotating upon an occurrence of a predetermined event (dropping of a pachinko ball into specified holes), and three rotating drums of the slot machine start rotating as a result of player's instruction. Each of the rotating drums of the pachinko machine successively stops rotating after a predetermined elapsed time, while each of the rotating drums of the slot machine successively stops rotating upon instruction by the player, then each drum displays one of a plurality of symbols at the front of the game machine. In the case where all symbols shown on the front of the three drums are the same when the three drums stop, a prize awarding combination is realized. A condition just before the prize awarding combination is realized, namely, the condition that the symbols on the front of the first and second drums, for example, are the same when they stop their rotations successively, and if the third drum which is still rotating stops with the same symbol on its front so as to effect a prize awarding combination, is called a condition where "reach" is being effective which means a win is imminent.

In the apparatus for indicating the prize awarding combinations on the rotating drums, such as conventional game machines, the size and the shape of the three rotating drums are the same and the size of the symbols shown on an outer peripheral plane of each drum are the same. Therefore, there is no change of the appearance in the apparatus for the prize awarding combinations when the rotating drums are still, and the three rotating drums appear to be simply rotating when they are rotating. Accordingly, players get tired of the games easily since the appearance of the game machine is simple.

SUMMARY OF THE INVENTION

It is an object of the present invention to provide an apparatus for showing prize awarding combinations on rotating drums, which has a new structure, and a game machine utilizing the apparatus.

It is another object of the present invention to provide an apparatus for showing prize awarding combinations providing varied appearance and a game machine having the apparatus.

To accomplish such objects of the present invention, there is provided an apparatus having three rotating drums for showing prize awarding combinations for a game machine, comprising:

a first rotating drum having an outer peripheral surface on which a plurality of symbols are shown, which is rotatable around an axis;

a second rotating drum having an outer peripheral surface on which said plurality of symbols are shown, which is arranged laterally adjacent to one side of the first rotating drum and rotatably around said axis;

a third rotating drum having an outer peripheral surface on which said plurality of symbols are shown, which is arranged laterally adjacent to the other side of the first rotating drum and rotatably on said axis; and a rotation control means for controlling rotation of each of the first, second and third drums separately;

said first, second and third drums forming It spherical shape in combination together.

According to the present invention, the apparatus for showing prize awarding combinations has an interesting appearance compared with the conventional drums whose shape is simply cylindrical, because of the spherically shaped appearance of the three rotating drums. In particular, an illumination plate which is formed to be extended conically, outwardly and forwardly from the rotating drums is provided around the apparatus for showing prize awarding combinations, so that the symbols shown on the outer peripheral surface of the rotating drums are reflected by the surface of the illumination plate, while when the illumination plate is illuminated, the illumination reflects onto a surface of a transparent cover of the rotating drums. Accordingly, even when the rotating drums do not rotate, the appearance of the apparatus for showing prize awarding combinations is seen to be changed depending on a player's viewing angle and when the rotating drums are rotating a more visual effect is achieved than when only three rotating drums are rotating because of the reflection of the symbols on the outer peripheral surface of the rotating drums on the illumination plate.

Further, in the case where the "reach" is being effective and the prize awarding combination is realized, a greater illuminating effect is achieved by the reflection of the illumination plate to a spherical surface in front of the transparent cover. Thus expectation, thrill and excitement of the players can be raised.

DETAILED DESCRIPTION OF THE PREFERRED EMBODIMENTS

Figure 5:
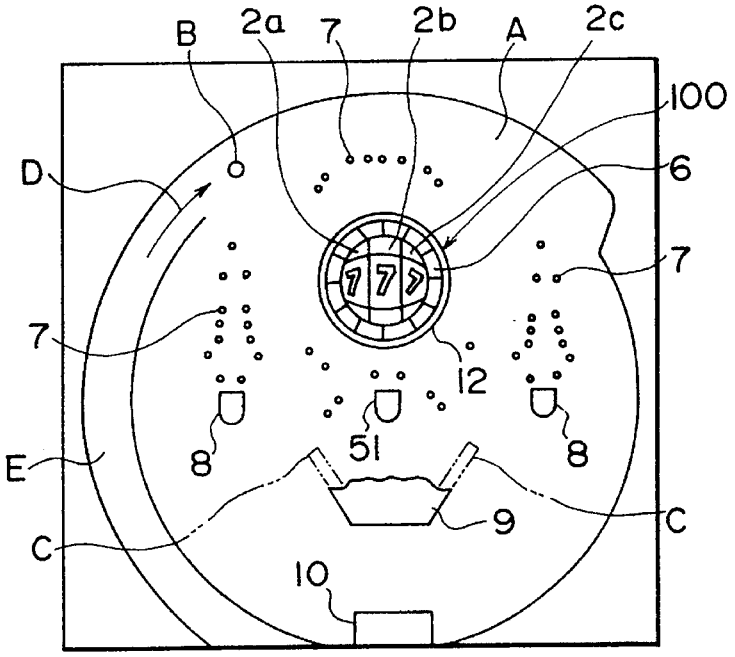
FIG. 5 is a front view of a pachinko machine using the apparatus of FIG. 1.

FIG. 5 shows a front view of a significant part of a pachinko machine applied to the present invention. An apparatus for showing prize awarding combinations on rotating drums 100 which comprises three rotating drums 2*a*, 2*b* and 2*c* according to the present invention is provided substantially on the center of a game board A. Further, a large number of nails 7 which flip or guide a pachinko ball B, a starter 51 in which a pachinko ball enters so as to start rotation of the drums, a winning entrance for small amounts 8 a winning entrance for big amounts 9 into which a lot of pachinko balls enter by opening a gate C when a prize awarding combination is realized, and an 'out' hole 10 for collecting the pachinko balls which have not won in a pachinko game. Other winning, entrances than the winning entrance for big amounts 9 may be provided on the game board A, although they are not shown.

As is generally known, the pachinko balls are discharged from a mechanical apparatus for discharging the pachinko balls (not shown) upwardly onto the game board A along a guide E, at a certain rate of balls per minute, by the handle operation of the player. The pachinko ball B which was discharged upwardly onto the game board is flipped or guided by the nails 7 and then drops onto the game board moving irregularly. During the dropping of the pachinko ball B, the rotating drums 2*a*, 2*b* and 2*c* of the apparatus for showing prize awarding combinations 100 start rotating when the pachinko ball B enters into the starter 51. The rotating drums 2*a*, 2*b* and 2*c* stop their rotations successively after a predetermined time. At this time, if the symbols shown on the front of each drum are all the same, a prize awarding combination is realized. Once the prize awarding combination is realized the gate C of the winning entrance for big amounts 9 is opened (or opened and closed intermittently), thereby a lot of pachinko balls can win in a short time. Beside, when another pachinko ball enters into the starter 51 while the rotating drums are rotating, the number of the pachinko balls which enter into the starter are stored up to a predetermined number (up to 4 according to the present embodiment), then reopening and stopping of the rotation of drums are repeated according to the number of stored balls as long as the the prize awarding combination is not realized after the rotating drums stop. A reservation lamp, described below, indicates the number of stored pachinko balls.

Once a pachinko ball enters into the winning entrance (including the starter 51) (namely, if a pachinko ball wins), a plurality of pachinko balls are discharged onto tin output tray (not shown) provided at a lower portion of the game board A. The number of pachinko balls to be output per one winning can be different depending on the winning entrances. The pachinko balls which are discharged onto the output tray can be used as the pachinko balls which are flipped again onto the game board. After playing the game, all of the pachinko balls which are collected in the output tray as well as those in, a pachinko ball pool (not shown) which stores the pachinko balls overflowed from the output tray provided under the output tray, and further the pachinko balls in the pachinko ball case in which the player shunts the pachinko balls from the pachinko ball pool, can be exchanged for one or a plurality of premiums based upon the total number of pachinko balls.

Figure 1:
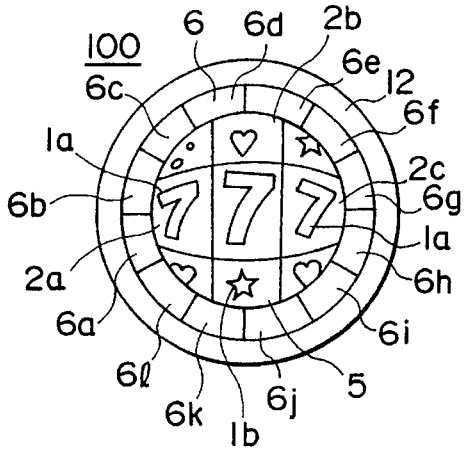
FIG. 1 is a front view showing a significant part of an apparatus for showing prize awarding combinations of an embodiment of the present invention.
Figure 4:
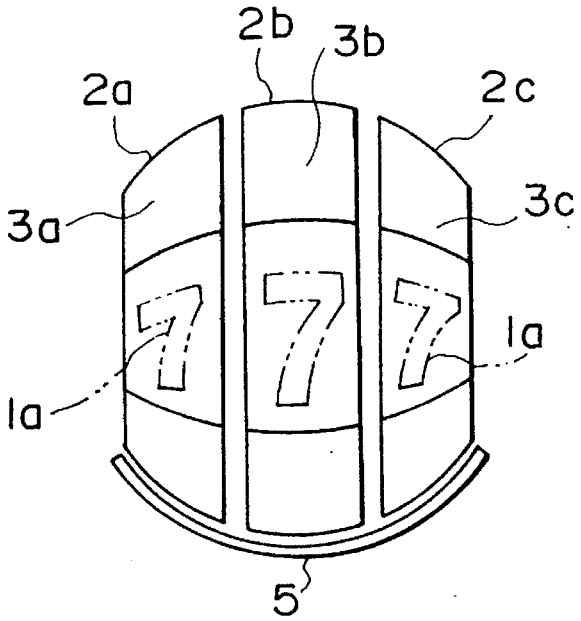
FIG. 4 is a plan view showing rotating drums employable in the apparatus of FIG. 1 and a cover thereof.

An enlarged front view of the apparatus for showing prize awarding combinations 100 of FIG. 5 is shown in FIG. 1. The three rotating drums, namely, a side rotating drum 29 a center rotating drum 2*b* and another side rotating drum 2*c* are arranged adjacent to each other and rotatably around a common horizontal axis which is parallel to the game board. These three rotating drums are constituted so as to form a truncated sphere in combination. A set of symbols such as numbers or patterns is shown or printed on the outer peripheral surface (refer to 3*a*, 3*b* and 3*c* in the FIG. 4) of each rotating drum. Each drum has the same set of symbols, but an order of the symbols on each drum may be different. Although the symbols of the each drum are the same, their sizes or shapes differ depending upon on which drum the symbol exists. Accordingly, the sizes of the symbols shown on the side rotating drums 2*a* and 2*c* are smaller, and the shapes of the symbols are distorted along the surface of the sphere A ring shaped illumination plate 6 is provided around the rotating drums so as to surround the rotating drums. The illumination plate 6 is formed with a transparent or colored semitransparent plastic material and the like, and is divided into a plurality of segment parts 6*a*–61 as shown. A lamp or Luminescent Diode (LED) is provided at the rear of each segment part as will be described below, so as to function as a illumination and a reservation lamp, in the event of "reach" or prize awarding. A ring shaped support board 12 is provided around the illumination plate 6. Furthermore, a transparent cover 5 is provided in front of the three rotating drums. A substantial embodiment relating to the support of the transparent cover 5 and the illumination plate 6 will be described below according to FIG. 2.

Figure 2:
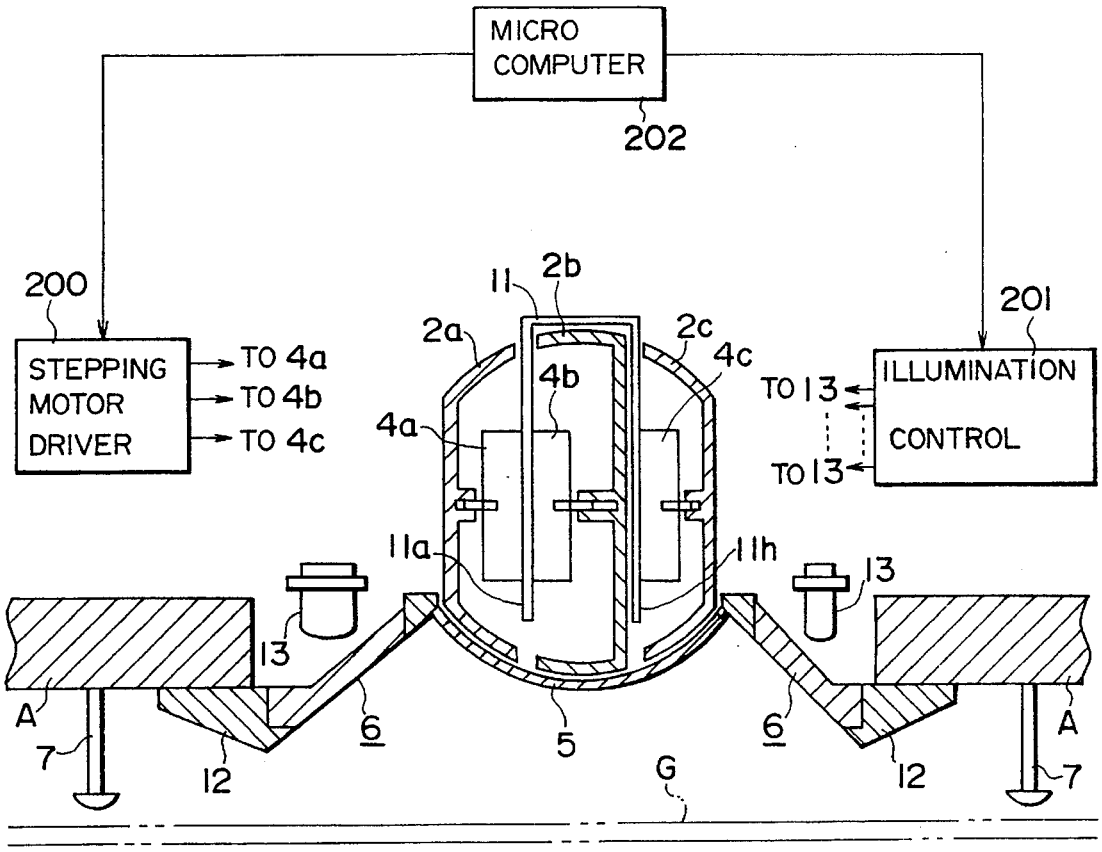
FIG. 2 is a sectional view showing a significant part of the apparatus shown in FIG. 1 and associated parts thereof.

FIG. 2 is a sectional view along a horizontal plane across the apparatus for showing a prize awarding combination 100. As shown in FIG. 2 the transparent cover 5 is flexed so as to follow the outer spherical surface of the rotating drums and an end part of the round shape is fitted and fixed into an opening of the ring of the illumination plate 6. The illumination plate 6 is formed conically so as to expand its shape toward the outside as moves away from the rotating drums. The outer periphery of the illumination plate 6 is fixed at a circular edge inside the ring-shaped support board 12. Further, the ring-shaped support board 12 is fixed at the edge of the circular opening provided on the game board A. A glass board G is provided in front of the game board A so that the pachinko balls do not spring out. The lamp (or LED) 13 is provided at the rear of each segment part of the illumination plate 6.

The rotating drums 2*a*, 2*b* and 2*c* are formed as hollow containers and fixed, at center parts thereof, to a support frame 11, which has a U-shaped section, through stepping motors 4*a*, 4*b* and 4*c*. More specifically, both arm portions 11*a* and 11*h* of the support frame 11 are positioned on a plane on which the rotating drums face each other. An indication frame is fixed to a main body of the game machine (not shown). Stepping motors 4*a* and 4*b* are fixed on either side of the arm portion 11*a*, respectively, and the side rotating drum 2*a* and the center rotating drum 2*b* are secured to the shafts of the two motors. On the other hand, the stepping motor 4*c* is fixed to the outer surface of the arm portion 11*h*, and the other side rotating drum 2*c* is secured to the shaft of the motor 4*c*. The rotation of each stepping motor is controlled by a stepping motor driver 200, respectively. Furthermore, the illumination of the lamp 13 is controlled by an illumination control unit 201. Moreover, the control of these circuits is realized by a predetermined program control by a microcomputer 202.

The symbol shown on the front most outer peripheral surface of each of the three rotating drums when the drum stops is not shown in the figures, but can be determined by a common means such as a rotary encoder which is mounted on each drum.

Alternatively, since a rotation angle of the rotation drum against the standard angle at an arbitrary time is determined by the characteristics of the motor according to the detection of a standard position of one rotation or an initial rotation angle of each stepping motor by a photo-interrupter or the like, the symbol shown on the front of the game board can be identified based on the software.

Figure 3:
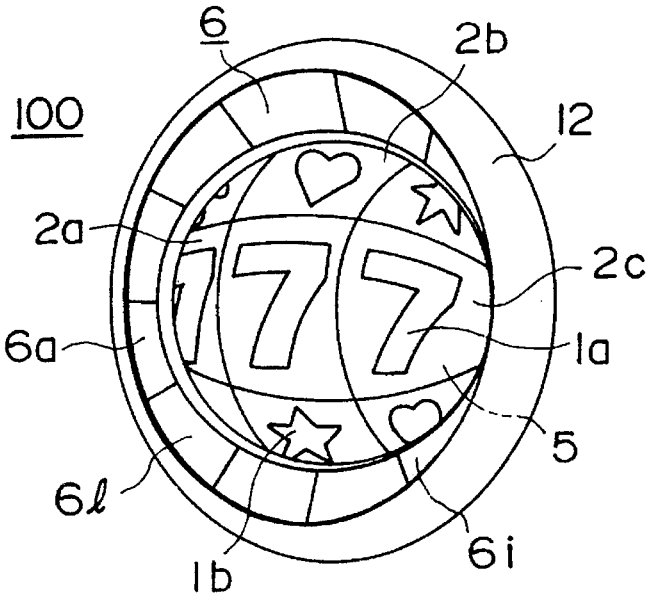
FIG. 3 is a perspective view of the apparatus of FIG. 1.

FIG. 3 is a perspective view of the apparatus for showing prize awarding combinations. As described above, the appearance of the three rotating drums, is a spherical shape, and the illumination plate 6 which is provided around the rotating drums has a conical shape which expands outwardly and forwardly, therefore the symbols shown on the outer peripheral surface of the rotating drums are reflected on the surface of the illumination plate 6, while when the illumination plate illuminates, the illumination reflects onto the surface of the transparent cover 5. Accordingly, when the rotating drums are not rotating the appearance of the apparatus for showing prize awarding combinations 100 is changed according to a visual angle of the player, further, when the rotating drums are rotating, a greater visual effect is achieved than when only three drums are rotating because of the reflection of the symbols on the rotating drums. Moreover, when the "reach" is being effective and the prize awarding combination is realized, the segments *6a–6h* successively rotate circumferentially and illuminate (turn on and off), and the illumination reflects on the spherical surface of the transparent cover 5, so the expection, thrill and excitement of the player can be raised. The segments *6i–6l* are used as the above mentioned reservation lamp. The method for illuminating the illumination plate 6 is not limited to rotation, it may be illuminated by any desired method.

Figure 6:
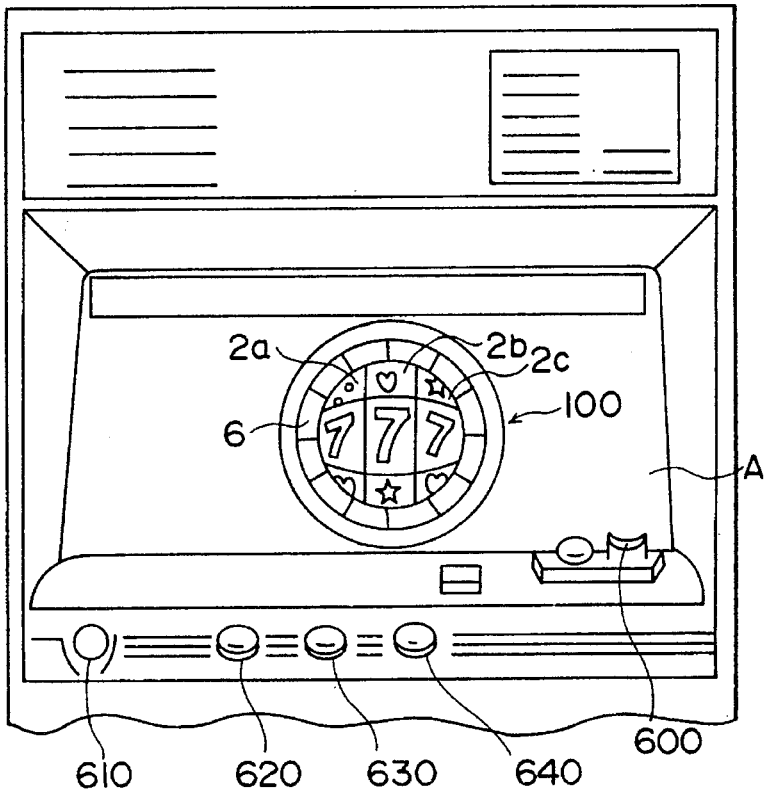
FIG. 6 is a front view of a slot machine using the apparatus of FIG. 1.

FIG. 6 is a alternative embodiment of the apparatus for showing the prize awarding combinations applied to a slot machine. The method for playing the slot machine is different from that of pachinko, although the structure of the apparatus for showing prize awarding combinations 100 is the same as the above described embodiment. The player inserts a coin into a coin insert slot 600 and pushes a start button 610, so that the three rotating drums start rotating When the player pushes the stop buttons 620, 630 and 640 in the desired order and timing, the corresponding rotating drum stops rotating according to the order and timing. If the arbitrary two drums stop and their symbols are the same, it is under the condition of the "reach" and the illumination plate turns on and off, so as to illuminate. Furthermore, if the third rotating drum stop rotating and the symbol shows the same symbol as the first and second drums, the prize awarding combination is realized, and a predetermined number of coins which was determined by the belted coins and the rank of the prize awarding combination are paid back. In this slot machine, the effect characterized in the apparatus for showing prize awarding combination 100 described above can be acquired.

What is claimed is:

1. An apparatus having three rotating drums for showing prize awarding combinations of symbols for a game machine, comprising:

a first rotating drum having an outer peripheral surface on which a plurality of symbols are shown and which is rotatable around an axis;

a second rotating drum having an outer peripheral surface on which a plurality of symbols are shown, which drum is arranged adjacent to one side of the first rotating drum and rotatably around said axis;

a third rotating drum having an outer peripheral surface on which a plurality of symbols are shown, which drum is arranged adjacent to another side of the first rotating drum and rotatably on said axis;

a rotation control means for controlling rotations of said first, second, and third drums, separately;

said first, second and third drums generally presenting, in combination, a surface forming a part of a sphere a partially spherical transparent cover provided in front of said first, second and third rotating drums such that said cover protects said surface of said surface of said first, second and third drums, said cover passing internal light therethrough while reflecting external light at the curved surface thereof; and a ring-shaped light transmitting plate surrounding said cover and having intermittently operable illuminating means therebehind, said light transmitting plate extending conically, outwardly and forwardly from an edge of said transparent cover.

2. An apparatus for showing prize awarding combination according to claim 1, wherein:

sizes of the symbols shown on the outer peripheral surfaces of said second and third rotating drums are smaller than that of the symbols shown on the outer peripheral surface of said first rotating drum.

3. An apparatus for showing prize awarding combinations according to claim 1, wherein:

each of the first, second and third rotating drums is formed as a hollow container: and inside each of said rotating drums, there is provided a motor for rotating the drum.

4. An apparatus for showing prize awarding combinations according to claim 1, further comprising:

a controlling means for turning on and off said illuminating means of said light transmitting plate, after the first, second and third rotating drums start rotating, and at the time when two rotating drum successively stop rotations and two symbols shown on the front thereof are the same.

5. An apparatus for showing prize awarding combinations according to claim 1, wherein:

said light transmitting plate is divided into a plurality of segment parts, and each of said segment parts has a plurality of illuminating means provided at the rear of said light transmitting plate, respectively.

6. A pachinko game machine including an apparatus having three rotating drums for showing prize awarding combinations of symbols, comprising:

a first rotating drum having an outer peripheral surface on which a plurality of symbols are shown and which is rotatable around an axis;

a second rotating drum having an outer peripheral surface on which said plurality of symbols are shown, which drum is positioned adjacent to another side of the first rotating drum and rotatably on said axis;

a third rotating drum having an outer peripheral surface on which said plurality of symbols are shown, which drum is positioned adjacent to another side of the first rotating drum and rotatably around said axis;

said first, second and third drums generally presenting, in combination together, a surface forming a part of a sphere; and said apparatus for showing prize awarding combinations further comprising:

a rotation control means for independently controlling rotation and stopping of each of said first, second and third drums, such that said first, second and third drums start their rotations at the same time upon an occurrence of a predetermined event in said pachinko game machine and stop their rotations sequentially and automatically after a predetermined elapsed time;

a ring-shaped light transmitting illumination plate surrounding said first, second and third drum, said illumination plates having intermittently operable illuminating means; and a flashing means for tuning on and off said illuminating means of said illumination plate, at a time when the first and second rotating drums having sequentially stopped after said first, second and third rotating drums started rotating and, if two symbols shown on the peripheral surfaces of the first and second rotating drums are the same.

7. A game machine according to claim 6, wherein:

sizes of symbols shown on an outer peripheral surface of said second and third rotating drums are smaller than that of the symbols shown on an outer peripheral surface of said first rotating drum.

8. A game machine according to claim 6, wherein each of said first, second and third rotating drums are formed as a hollow container: and said rotation control means are arranged in each of said rotating drums, which has motors for rotating the rotating drums.

9. A game machine according to claim 6, further comprising:

a transparent cover formed as partially spherical surface which is provided in front of said first, second and third rotating drums.

10. A game machine according to claim 9, wherein:

said illumination plate is formed to be conical expanding, outwardly and forwardly from the edge of said transparent cover.

11. A game machine according to claim 6, wherein:

said illumination plate is divided into a plurality of segment parts, and each of said segment parts has a plurality of illumination means provided at the rear of said illumination plate, respectively.

* * * * *